US009057178B2

(12) United States Patent
Seljestad

(10) Patent No.: US 9,057,178 B2
(45) Date of Patent: Jun. 16, 2015

(54) STIFF LINK THUMB WITH DAMPENER

(75) Inventor: Gregory A. Seljestad, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 394 days.

(21) Appl. No.: 13/436,180

(22) Filed: Mar. 30, 2012

(65) Prior Publication Data

US 2013/0259627 A1 Oct. 3, 2013

(51) Int. Cl.

| | |
|---|---|
| ***E02F 3/40*** | (2006.01) |
| ***E02F 3/42*** | (2006.01) |
| ***E02F 9/22*** | (2006.01) |
| *E02F 3/413* | (2006.01) |

(52) U.S. Cl.

CPC ..... *E02F 3/404* (2013.01); *E02F 3/413* (2013.01); *E02F 3/425* (2013.01); *E02F 9/2271* (2013.01)

(58) Field of Classification Search

CPC ..... B66C 1/00; B66C 1/42; E02F 3/76; E02F 3/96; E02F 3/413

USPC ..... 414/722, 724, 729

See application file for complete search history.

(56) References Cited

U.S. PATENT DOCUMENTS

| | | | | |
|---|---|---|---|---|
| 4,033,469 | A | 7/1977 | Frank | |
| 4,531,883 | A | 7/1985 | Arnold | |
| 5,437,145 | A | 8/1995 | Farley et al. | |
| 5,484,250 | A | 1/1996 | Gilmore, Jr. et al. | |
| 5,553,408 | A | 9/1996 | Townsend | |
| 6,120,237 | A | 9/2000 | Cummings et al. | |
| 6,203,267 | B1 | 3/2001 | Heiple et al. | |
| 6,209,237 | B1 | 4/2001 | Heiple et al. | |
| 6,354,790 | B1 | 3/2002 | Cummings et al. | |
| 7,150,366 | B1 * | 12/2006 | Zakula et al. | 212/272 |

FOREIGN PATENT DOCUMENTS

| | | |
|---|---|---|
| FR | 2849008 | 12/2002 |

OTHER PUBLICATIONS

U.S. Appl. No. 13/301,003, filed on Nov. 21, 2011.

U.S. Appl. No. 13/168,053, filed on Jun. 24, 2011.

* cited by examiner

*Primary Examiner* — Saul Rodriguez

*Assistant Examiner* — Ronald Jarrett

(74) *Attorney, Agent, or Firm* — Bart A. Fisher; Miller, Matthias & Hull LLP

(57) ABSTRACT

A machine including an implement system pivotably mounted on the machine, a thumb member mounted on an arm of the implement system for free dampened back and forth pivotable movement, the thumb member being controllably pivotable into selectable pivot positions via controlled pivoting of one or the other or both of the arm and a bucket member, a dampener being interconnected between the thumb member and the arm in an arrangement where the dampener dampens free pivoting movement of the thumb member.

14 Claims, 14 Drawing Sheets

STIFF LINK THUMB WITH DAMPENER

TECHNICAL FIELD

The present disclosure is directed to a machine having a thumb assembly manually adjustable to multiple selectable fixed positions. More particularly, the present disclosure is directed to a thumb member in a machine whose movement is dampened via a dampener.

BACKGROUND

Machines such as excavators, backhoe loaders and the like typically employ a implement system or assembly comprised of one or more controllably articulable arms extending from a base or frame and other additional components that are pivotably attached to a distal portion of one or more of the arms such as a bucket and thumb. Such individual components are typically very heavy in weight in and of themselves and must be adjusted to one or more fixed positions to perform intended operations. Due to their weight, such components may not capable of being manually adjustable by one person to the one or more fixed pivot positions. U.S. Pat. Nos. 6,120,237 and 6,354,790 disclose machines having assemblies on which such a heavy thumb member is pivotably attached. The thumb member is movable to selected pivot positions relative to other components of the assembly by a drive system operated remotely by a user sitting in a cab.

SUMMARY

In one aspect, the present disclosure is directed to a machine comprising: a frame, an engine, an implement assembly, a bucket, a thumb member, a dampener and a control assembly adapted to enable control of movement of the machine; the thumb member being mounted for free dampened back and forth pivotable movement on an arm or stick of the implement system; the bucket being controllably pivotably mounted on the arm or stick and adapted to be movable into controlled engagement under force with the thumb member; the thumb member being controllably pivotable into selectable pivot positions via controlled pivoting of one or the other or both of the stick and the bucket member such that a pivot force is exerted on the thumb member; the dampener interconnected between the thumb member and the stick in an arrangement wherein the dampener dampens free pivoting movement of the thumb member by absorbing at least a portion of the pivot force exerted on the thumb member.

In another aspect, the disclosure is directed to a method of controllably positioning a thumb member in a machine comprising an implement system controllably pivotably mounted on the machine and a bucket member controlling pivotably mounted on the implement system, the thumb member being mounted on an arm of the implement system for free back and forth pivotable movement thereon, the method comprising: controllably pivoting one or the other or the other or both of the arm and the bucket member to cause the thumb member to undergo free pivoting movement under either force of gravity or force of engagement with the bucket member; and, dampening the free back and forth pivoting movement of the thumb member.

In another aspect, the disclosure is directed to a thumb assembly comprising: a thumb member mounted on an implement system for back and forth free pivotable movement thereon, a rigid link adjustably interconnectable between the thumb member and an arm of the implement system to fix the thumb member and a dampener interconnected between the thumb member and the arm; the dampener comprising an assembly that operates passively to dampen the free pivotable back and forth movement of the thumb member.

Various embodiments of the present application contain only a subset of the advantages set forth. No one advantage is critical to the embodiments. Any claimed embodiment may be technically combined with any other claimed embodiment(s).

BRIEF DESCRIPTION OF THE DRAWINGS

The drawings illustrate exemplary embodiments of the disclosure and when accompanied with the description provided herein serve to explain the present disclosure by way of example and should not be construed to limit the present disclosure.

DETAILED DESCRIPTION

Figure 1:
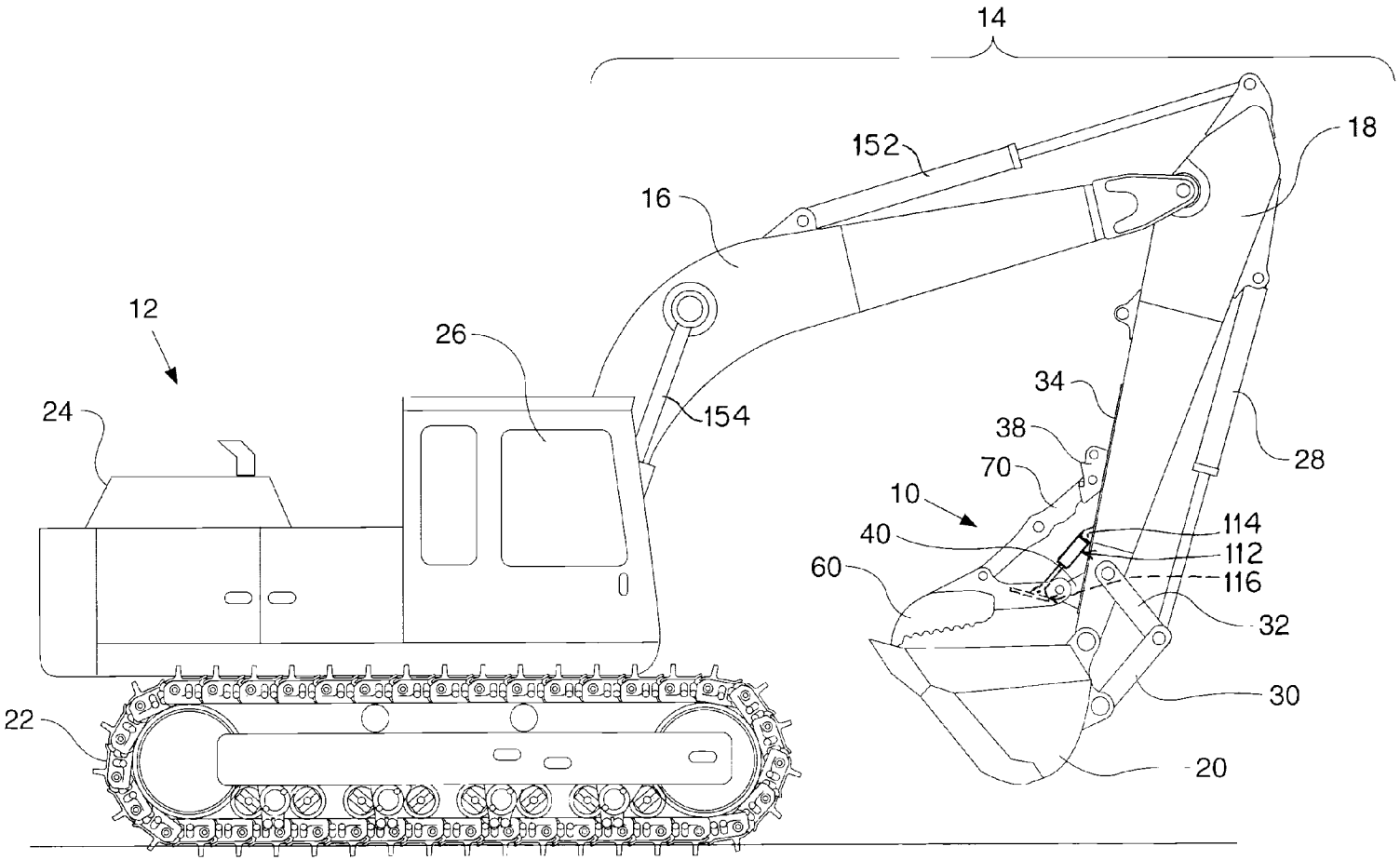
FIG. 1 is a side view of a machine provided with a bucket thumb assembly and having a connection assist system with a connecting pin alignment indicator and a dampener shown interconnected between a thumb member and a controllably movable arm according to an embodiment of the present disclosure.

The present disclosure relates generally to a pivotable thumb member 60 configured for use with a bucket 20 on an implement system 14 of a machine, such as a material-handling machine. The implement system 14 comprises a boom 16 and an arm or stick 18. More specifically, the present disclosure relates to a thumb assembly 10 having a dampener 112 that dampens pivot movement of the thumb member 60. The dampener 112 preferably comprises a passive device or operates passively meaning that the dampener 112 is not separately driven by driven fluid, pump, engine, motor, electrical energy or the like in order to effect dampening of the force or energy exerted on the dampener on pivoting of the thumb member. While embodiments discussed herein and shown throughout the figures relate to a thumb assembly coupled to an excavator machine, it should be readily understood by those having ordinary skill in the art that embodiments of the present disclosure might be easily coupled to and used with other types of machines.

FIG. 1 illustrates a side view of a machine (e.g., an excavator) 12 provided with an embodiment of a bucket thumb assembly 10 having a connection assist system with a connecting pin alignment indicator. The machine 12 may embody a fixed or mobile machine that performs some type of operation associated with an industry such as mining, construction, farming, transportation, or any other industry. For example, machine 12 may be an earth-moving machine such as an excavator, a backhoe, a material-handling machine, or any other machine that could utilize a thumb assembly.

Machine 12 may include an implement system 14 that includes a boom 16, a stick or elongated lifting arm 18 pivotally attached to the boom 16, a bucket 20 pivotally attached to the stick 18. The boom 16, stick 18 and bucket 20 are not freely pivoting or pivotable but instead are controllably driven and pivotable selected pivot positions. The thumb assembly 10 is freely pivotally attached to the stick 18 with a motion, force or energy dampener 112 such as a shock absorber interconnected between an elongated controllably pivotable lifting arm 18 and a thumb 60. The machine 12 may also include a drive system 22 for propelling the machine 12, an engine or power source 24 that provides power to the implement system 14 and the drive system 22, and an operator station or cab 26 for operator control of implement system 14 and drive system 22.

The stick or lifting arm 18 is typically hydraulically driven to move bucket 20 to a location where the bucket 20 can be curled to scoop up material (e.g., dirt, rocks, sand, bricks, and/or other materials) (not shown), and then to move the bucket 20 to a location where the bucket 20 can be uncurled to empty the scooped material from the bucket 20. The curling and uncurling of the bucket 20 may be controlled by a hydraulic ram/cylinder 28 connected to the stick 18 and one or more linkage members 30, 32, which are pivotally connected to the stick 18 and bucket 20.

The power source 24 may include an engine such as, a diesel engine, a gasoline engine, a gaseous fuel-powered engine or any other type of engine. It is contemplated that power source 24 may alternatively embody a non-combustion source of power such as a fuel cell, a power storage device, a battery or any other type of power source. Power source 24 may produce a mechanical or electrical power output that may then be converted to hydraulic power for operating the implement system 14. The drive system 22 may include a track-drive system, a wheel-drive system, or any other type of drive system to propel the machine 12.

The thumb assembly 10 is attached to a portion of machine 12 and typically includes a base member 34, a thumb member 60 and a link member 70. The base member 34 may be mounted to the stick 18 by welding, fastening, bolting or by any other appropriate way. In the illustrated example, the base member 34 includes a base plate 36, which is attached to the underside of the stick 18, for example, by welding. Mounted on the base plate 36 are two spaced apart link member mounting plates 38 and two spaced apart thumb mounting lugs 40. In other embodiments, different quantities of the link member mounting plates 38 and the thumb mounting lugs 40 may be used. Each link member mounting plate 38 is provided with one or more attachment points or pivot joint locations 42, 44. In the illustrated example, each link member mounting plate 38 includes two pivot joint locations 42, 44, which are formed as a first pair of coaxial, circular link mounting apertures 46 and a second pair of coaxial, circular link mounting apertures 48 through which a removable connecting pin 50 can be inserted. Each pair of link mounting apertures 46, 48 correspond to a different working position or orientation of the thumb assembly 10.

The pivot joint locations 42, 44 may take forms other than the simple circular apertures illustrated in the figures. For example, each pivot joint location 42, 44 may include a coupling system for receiving one or more fasteners, which hold a mount (not shown) for a bearing or pin, so that a link member can be pivotally secured to the base member 34. Additionally, other embodiments may include a different number of pivot joint locations. In other words, the pivot joint locations 42, 44 may be formed having any suitable number and shape of apertures and any type of pin or other coupler may be used therein.

The link member mounting plates 38 and thumb mounting lugs 40 of the base member 34 may be secured to the stick 18 without the base plate 36. Thus, the base member 34 may comprise a number of unconnected pieces. The thumb mounting lugs 40 may be replaced by any other suitable pivot-type mounting system. Additionally, the thumb member 60 can be arranged to pivot on the pivot axis of the bucket 20.

Figure 2:
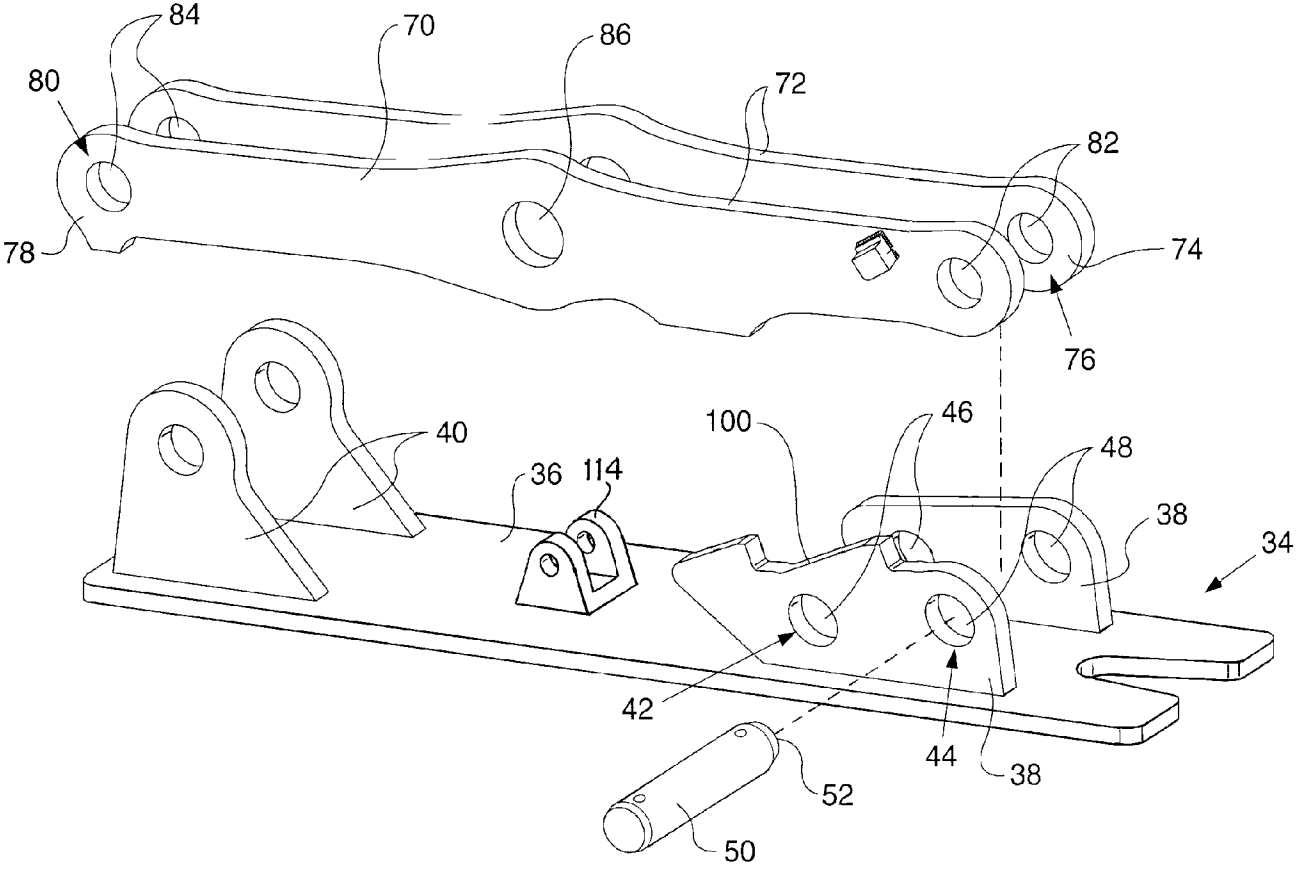
FIG. 2 is an exploded view of a portion of the thumb assembly of FIG. 1.

Referring now to FIGS. 2 and 3, the link member 70 may also be configured in a variety of ways. Any rigid link capable of being pivotally connected to both the thumb member 60 and the base member 34 may be used. In the illustrated embodiment, the link member 70 includes two connected parallel plates 72. The link member 70 includes a first end 74 having a first pivot joint location 76 and a second end 78 having a second pivot joint location 80. In the illustrated example, the first pivot joint location 76 is formed as a first pair of circular base mounting apertures 82 through which the removable pivot pin 50 can be located. Likewise, the second pivot joint location 80 is formed as a second pair of circular thumb mounting apertures 84 through which link mounting pin 69 can be located. It should be understood that in various embodiments the link member 70 may be integral with the thumb member 60.

The pivot joint locations 76, 80 may take forms other than the simple apertures illustrated. For example, each pivot joint location 76, 80 may comprise a mechanism that receives one or more fasteners which hold a mount (not shown) for a bearing or pin, so that the link member 70 can be pivotally secured to the base member 34 at the first end 74 and pivotally secured to the thumb member 60 at the second end 78. Thus, in other embodiments, more or fewer pivot joint locations can be provided and the pivot joint locations may be formed in any suitable manner, such as any suitable number and shape of apertures and any type of pin may be used.

The link member 70 may also include one or more storage position apertures 86 for fixedly holding the link member 70 in a storage position via the connecting pin 50 and the link mounting apertures 46, 48. In the depicted embodiment, the one or more storage position apertures 86 are formed as a pair of spaced apart circular apertures positioned between the base mounting apertures 82 at the first end 74 and the thumb mounting apertures 84 at the second end 78. For example, the storage position apertures 86 may be positioned along the length of the link member 70 approximately half way between the base mounting apertures 82 and the thumb mounting apertures 84. In the storage position, the link member 70 is folded back against the stick 18 such that the pin 50 (or other suitable holding device) can be received through both the storage position apertures 86 and the one set of link mounting apertures 46 or 48.

As shown in the embodiment of FIG. 2, removable connecting pin 50 is formed as a generally cylindrical rod configured to be tightly received through various apertures in the thumb assembly 10. For example, the connecting pin 50 may be configured to be received through the base mounting aperture 82 and the storage position apertures 86 on the link member 70 and also through the link mounting apertures, 46, 48 on the base member 34. The connecting pin 50 may include one or more tapered end(s) 52 to assist in installation of the pin through multiple apertures that are slightly misaligned. Thus, the connecting pin 50 may be tapered only on one end, on both ends, or may have a slight taper along the majority of the length of the pin 50. In an embodiment, the taper for tapered end 52 is approximately 10 degrees, however, other taper angles may be used. In addition, the connecting pin 50 may include one or more apertures through the pin 50 for receiving a keeper pin, such as a roll pin, a cotter pin, a lynch pin, etc. In an embodiment, the connecting pin 50 may be plated with a coating to reduce insertion/retraction friction or to reduce corrosion. One example of such coating is a chrome coating. However, other coatings may be used.

As shown in FIGS. 1, 5-14, the thumb 60 is freely pivotably mounted to the link arm 18, the free pivoting back and forth movement of the thumb 60 being slowed or dampened by dampener 112. Free pivoting movement or freely pivotable means that the pivot movement of the thumb 60 is not driven by a motor, engine, hydraulic, pneumatic or other drive mechanism or force but is effected via driven or controlled movement of one or the other or both of the implement system 14 including the link arm 15, and the bucket 20 as herein described.

As shown in FIGS. 3A-3D, 4-14, the dampener 112 is typically comprised of an assembly that can extend EXT and contract CON length or has a member connected to the thumb 60 that pivots together with and resists the pivot movement of the thumb 60. The FIGS. 1, 3A-14 embodiments of a dampener 112 comprises a cylinder 118 that houses piston 122 that divides the hollow interior of the piston into a pair of chambers 128, 130 disposed on opposing sides of the piston 122. In the piston 122 and cylinder 118 dampener embodiment of FIGS. 3A-14, the piston 122 is connected to a piston rod 120. The piston 122 and rod 120 are slidable back and forth within the fluid sealed interior of the cylinder 118 such that the overall length of the dampener 112 as defined by the opposing attachment members 148, 150 is extendable and contractable in length upon extension EXT or contraction CON of the piston 122 and rod 120 within the cylinder 118. The piston rod 120 and piston 122 travel passively back and forth, EXT, CON, within the cylinder 118 as a result of pivoting of the thumb member 60 on the arm 18 under either the force of gravity or mechanical force exerted on the thumb 60 by bucket 20.

Figure 7:
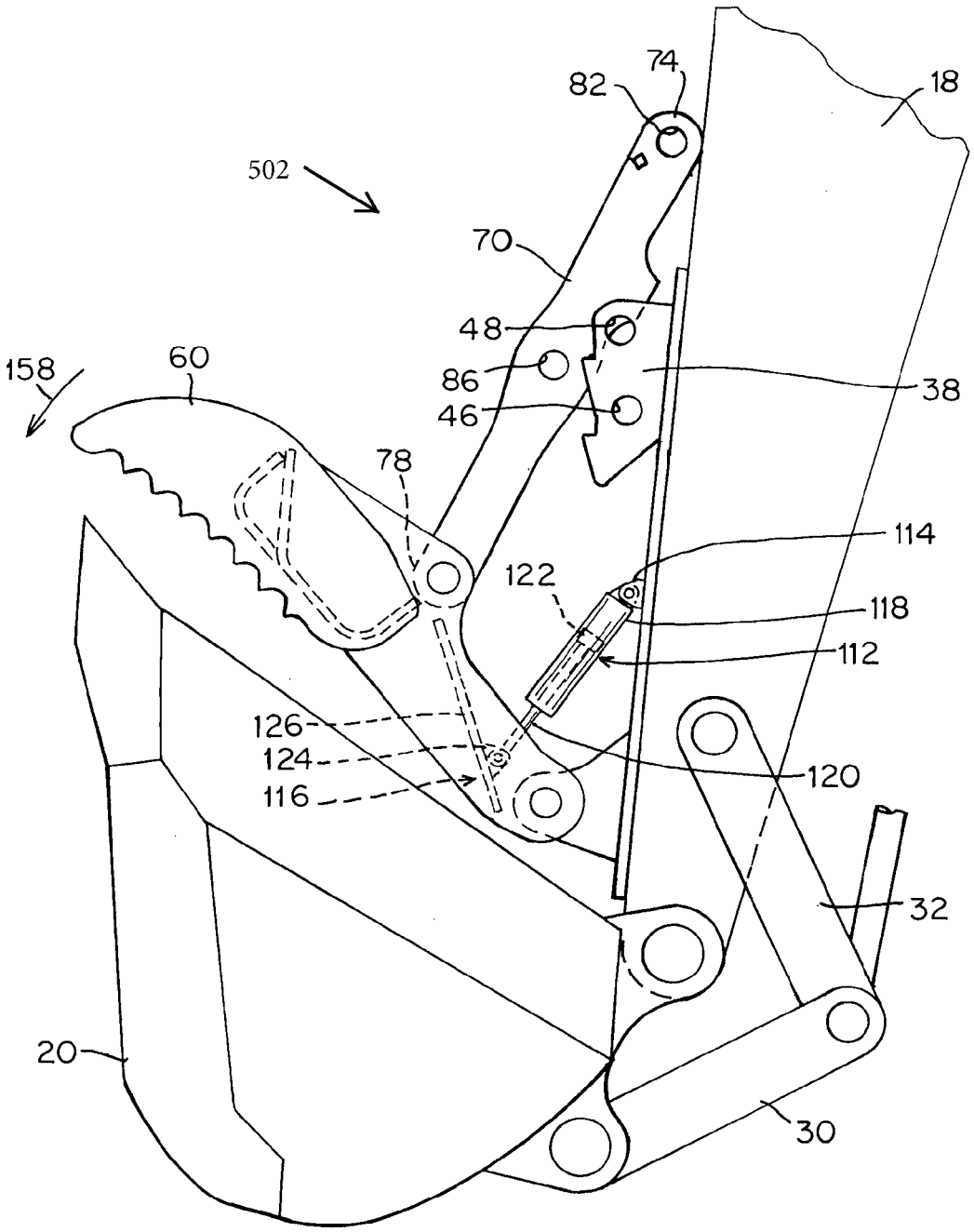
FIG. 7 is a next-in-sequence side view of the positions of the assemblies subsequent to FIG. 6.
Figure 8:
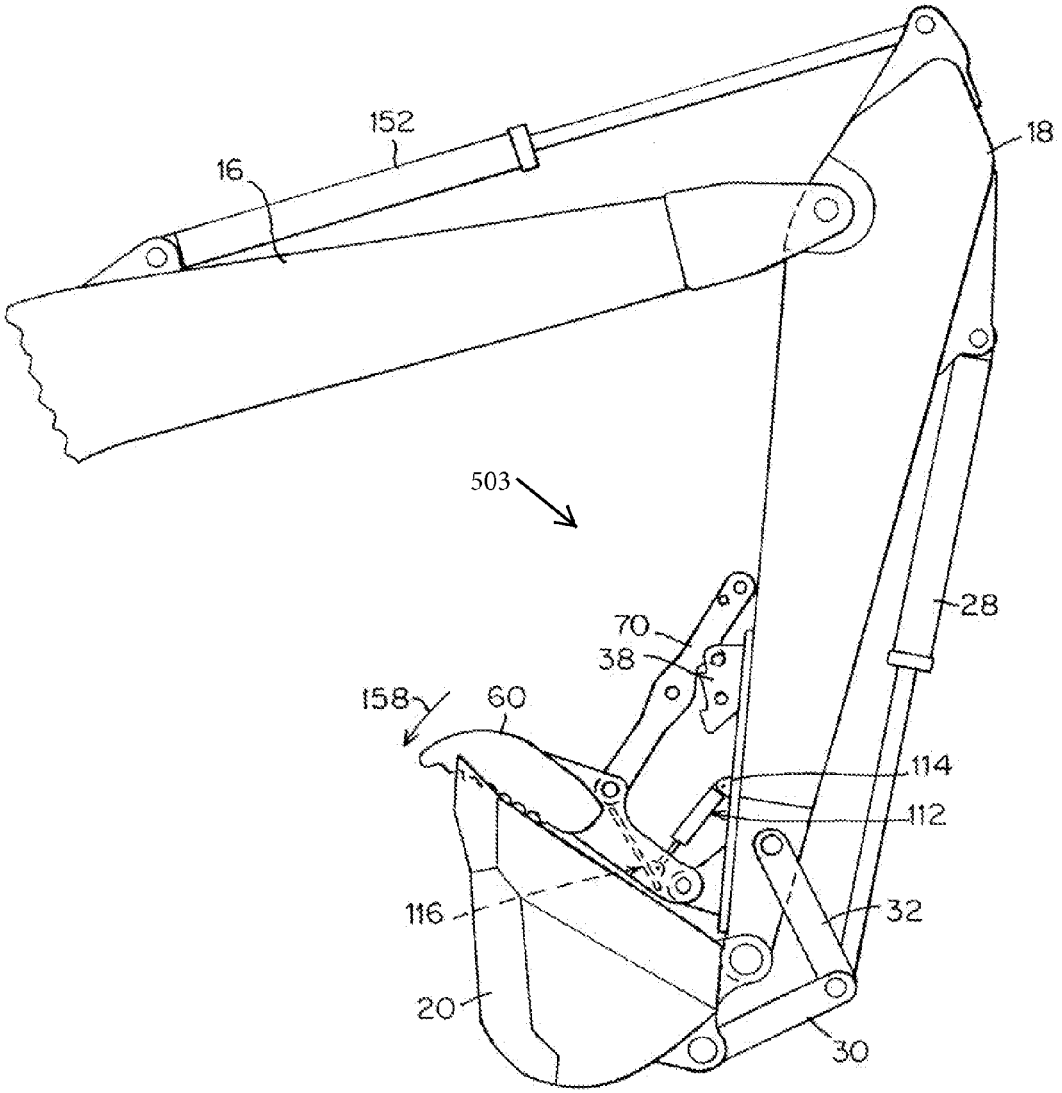
FIG. 8 is a next-in-sequence side view of the positions of the assemblies subsequent to FIG. 7.

In the piston 122, cylinder 118 dampener embodiments of FIGS. 3A-3D, the attachment members 148, 150 are pivotably attached by conventional means to complementary attachment brackets 114, 124 and bracket assembly 116 that are in turn interconnected to selected positions on the arm 18 and thumb 60, the thumb having an attached mounting plate 126 to which bracket 124 is attached. As shown in FIG. 7, bracket 114 is attached to base plate 36 of base member 34, one or the other of the attachment members 148, 150 being pivotably attachable to the one or the other of the brackets 114 126 such that the dampener can readily extend EXT and contract CON when the thumb 60 is pivoted on the link arm 18.

In the dampener 112 embodiments shown in FIGS. 3A-3D, the cylinder 118 houses and contains a selected gas or liquid fluid 136 that flows 134, 138 140, 146 between the chambers 128, 130 when the piston 122 slides back and forth within the cylinder 118. In the FIGS. 3A-3B embodiment, the fluid 136 flows through a single aperture 132 extending through piston 122 that a fluid communication bore between the opposing chambers 128, 130. Because the diameter and volume of the bore 132 is small relative to the volume or amount of fluid 136 that is forced under high pressure through the bore 132, the fluid 136 frictionally absorbs the force, movement or energy being exerted on and imparted to the fluid by the piston 122 when the piston-cylinder assembly 118-122 is forced back and forth (EXT, CON) by pivoting of the thumb 60 which causes the dampener 112 to either extend EXT or contract CON. Because there is a single fluid communication bore 132, the degree of dampening of movement or force is about the same on extension EXT or contraction CON of the FIGS. 3A, 3B embodiment of a dampener 112.

Figure 3A:
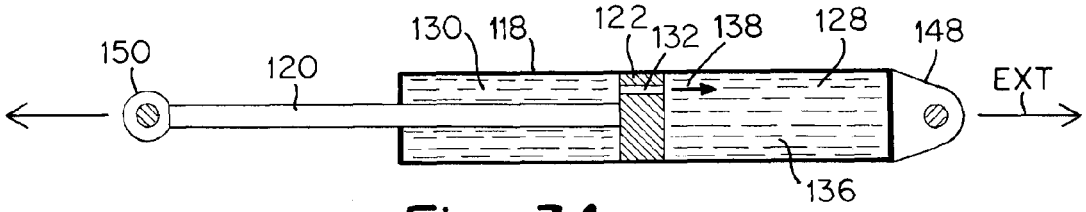
FIG. 3A is a side view of one embodiment of a dampener component of the thumb assembly showing a piston-rod being pulled in an extended EXT direction.
Figure 3B:
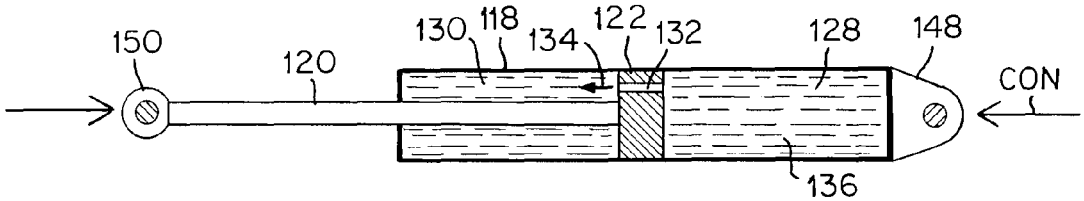
FIG. 3B is a side view of the FIG. 10A embodiment showing the piston-rod being pushed in the contracting CON direction.
Figure 3C:
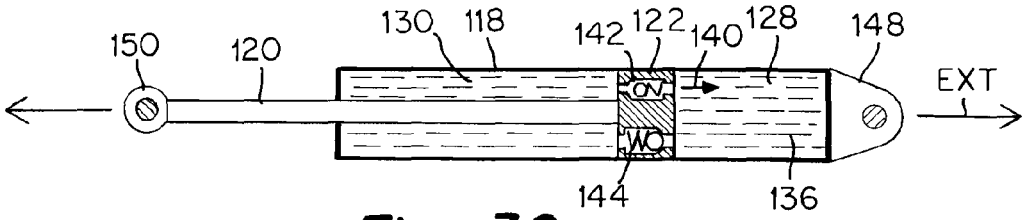
FIG. 3C is a side view of another embodiment of a dampener component of the thumb assembly.
Figure 3D:
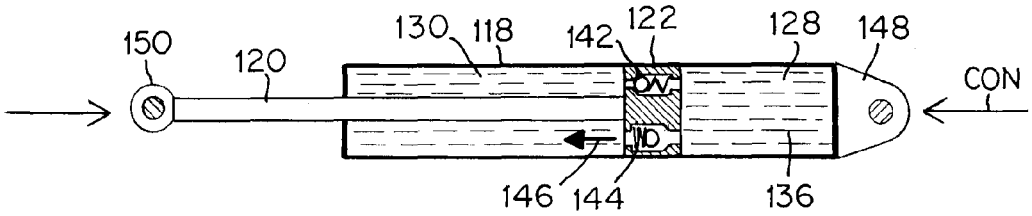
FIG. 3D is a side view of the FIG. 10C embodiment.
Figure 4:
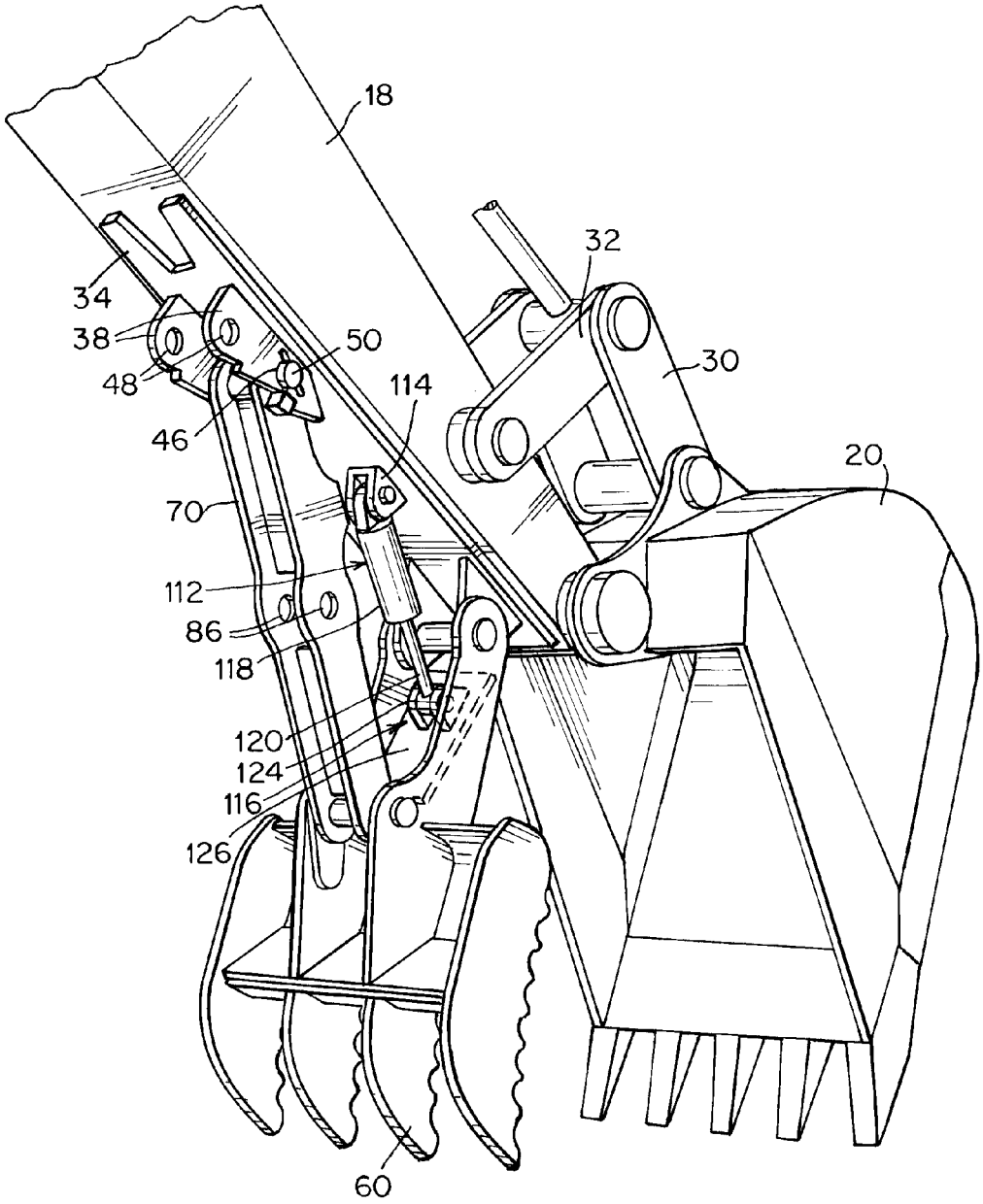
FIG. 4 is a rear perspective view of the thumb assembly and stick or pivot arm on which the thumb assembly is mounted showing a passive dampener interconnecting the thumb member and stick or pivot arm.

In the dampener embodiment of FIGS. 3C, 3D two one way flow valves 142 and 144 are disposed in the piston, one of the valves 142 enabling fluid flow 140 in one direction from chamber 130 to chamber 128 at one rate of flow 142 on extension EXT, the other of the two valves 144 enabling fluid flow 146 in the opposite direction from chamber 128 to chamber 130 at another rate of flow 146 on contraction CON. The different rates of fluid flow 142 and 146 thus enable the thumb 60 to pivot in one direction on extension EXT at one pivot speed or rate that may be faster or slower than the rate of pivoting of the thumb member 60 in the other direction on contraction CON of the dampener 112.

The dampener 112 preferably comprises an assembly that subjects fluid to friction to dissipate energy and thus dampen the free pivoting movement of thumb 60 as with the FIGS. 3A-3D embodiments. Alternatively the dampener can comprise, among other things, an assembly that operates by hysteresis of a suitable structural material such as compression or elongations of a spring or elastic material such as metal or polymeric springs. Alternatively, the dampener 112 may comprise an electro-rheological fluid damper, a magneto-rheological damper, and Eddy current damper, a gas compression dampener or any other known form of dampening device that can be interconnected to the thumb 60 so as to slow free pivoting movement of the thumb 60. Such dampener embodiments are typically passive or operate passively such that they react to and absorb the exertion of force applied by the pivoting of the thumb without force, energy, power or the like being applied directly to the dampener such as a driven fluid, electrical or mechanical energy that could be applied to a driven dampener via a pump, motor, engine, rheostat or the like. Dampeners that are driven independently of the thumb 60 can alternatively be employed.

Figure 5:
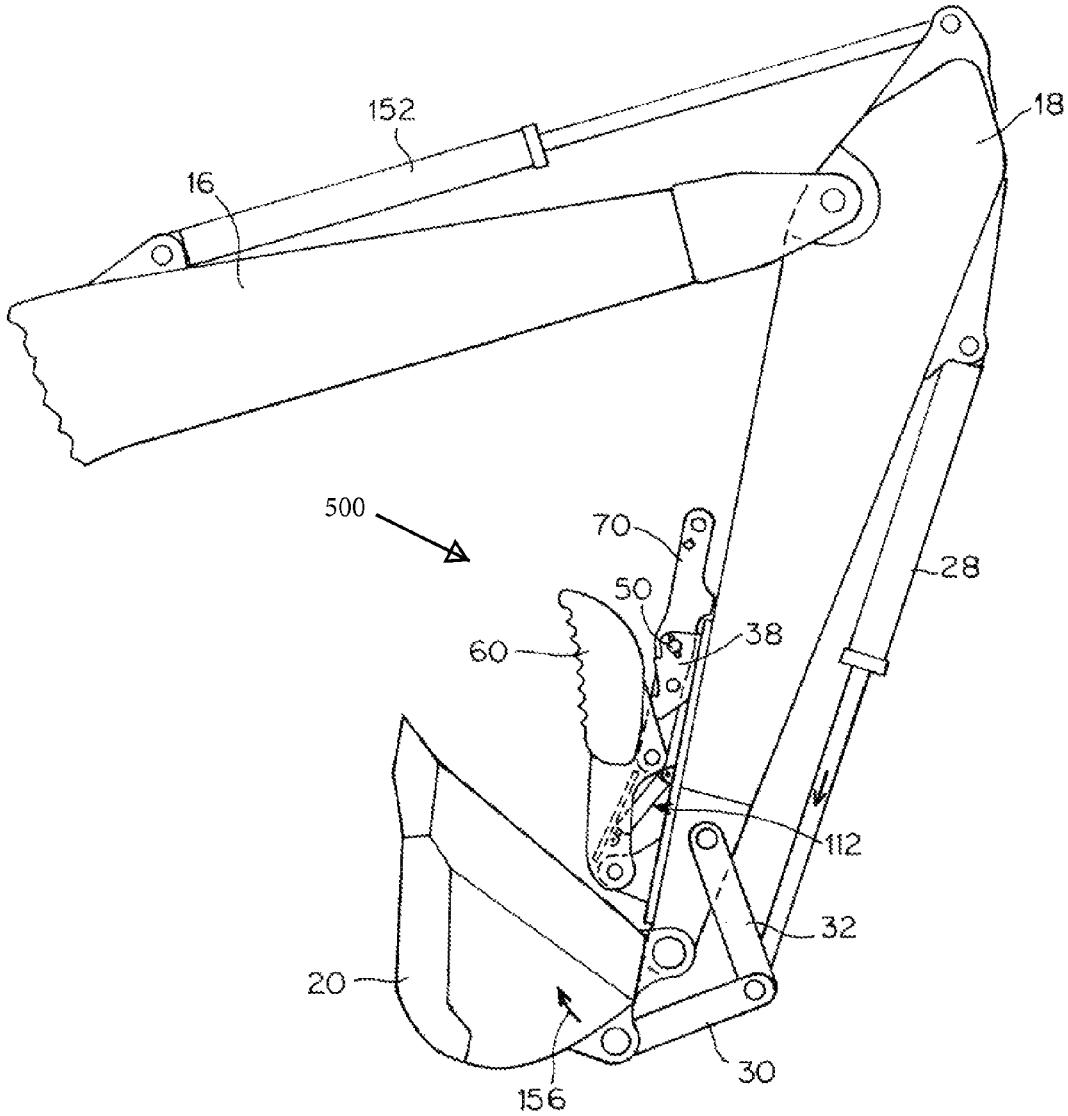
FIG. 5 is a side view of the implement system and thumb assemblies showing the thumb in an initial fixed storage.
Figure 14:
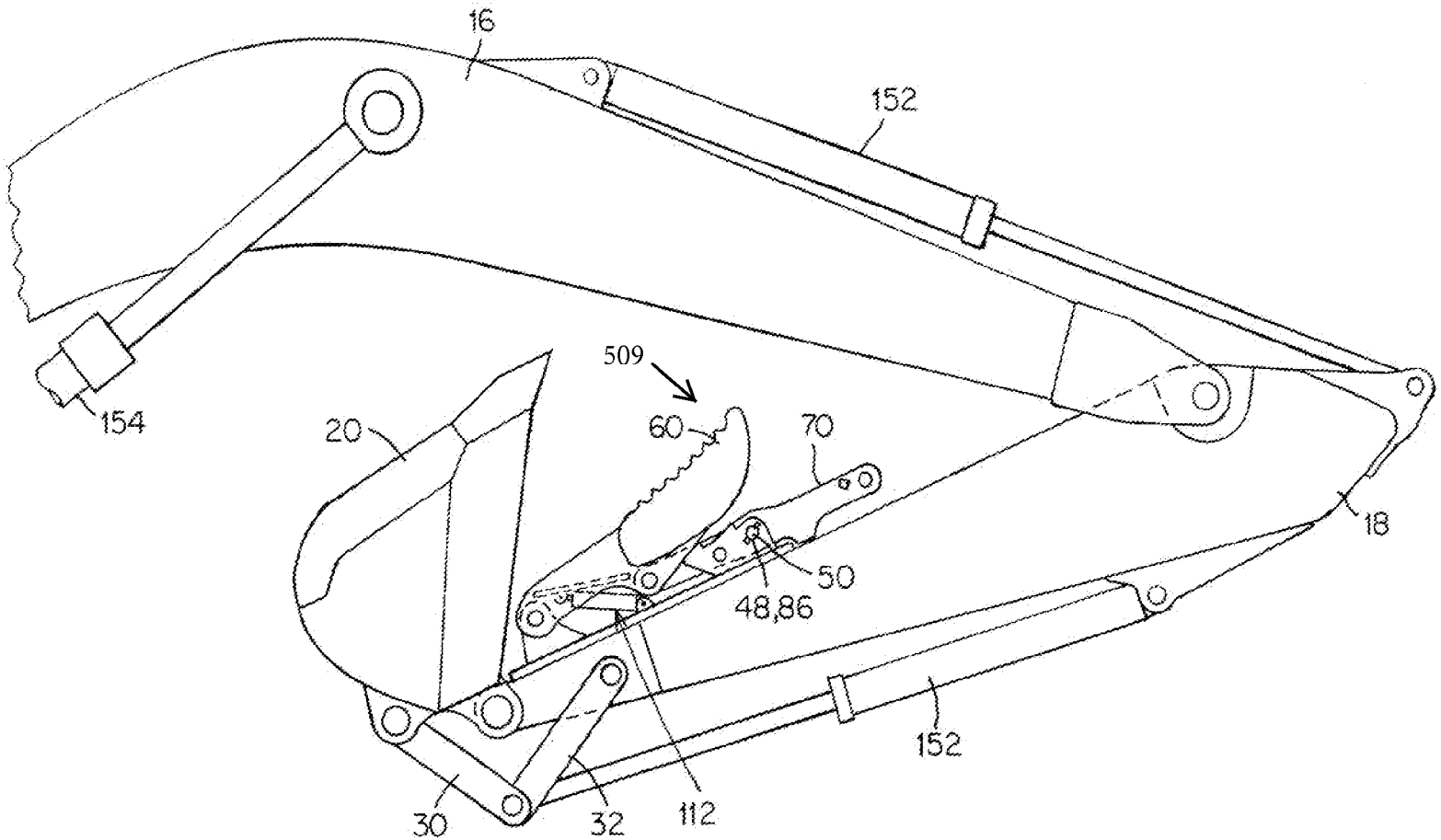
FIG. 14 is a next-in-sequence side view of the positions of the assemblies subsequent to FIG. 13.

FIGS. 5-14 show a series of sequential positions 500-509, respectively, of the implement system 14, boom 16, arm or stick 18, thumb 60, rigid link 70, bucket 20, dampener 112 and associated components in which the thumb 60 and rigid link 70 are controllably moved from a fixed storage position, FIG. 5, to a fixed operational position, FIG. 11, and back again to a fixed storage position, FIG. 14 via controlled driven movement of the implement system 14, boom 16, arm or stick 18 and bucket 20. The boom 16 and arm 18 of the implement system 14 are controllably driven from the cab 26 via first 152 and second 154 cylinder assemblies that typically comprise fluid driven (hydraulic or pneumatic) cylinder-piston-rod assemblies. Bucket 20 is also controllably drivable in a back 158 and forth 156 pivot direction via controllable driving of hydraulic cylinder 28. Thus controlled driven movement of the implement system 114 components and the bucket 20 enables the freely pivotable thumb 60 to be selectively positioned as follows. As shown in FIG. 5 is the boom 16 and thumb assembly 10 reside in an initial fixed storage position with the arm 18 and bucket 20 in a pivot position readied for release of the thumb member 60 from the fixed storage position such that the thumb member 60 can be manually released and allowed to move under its own weight into an operational position.

Figure 6:
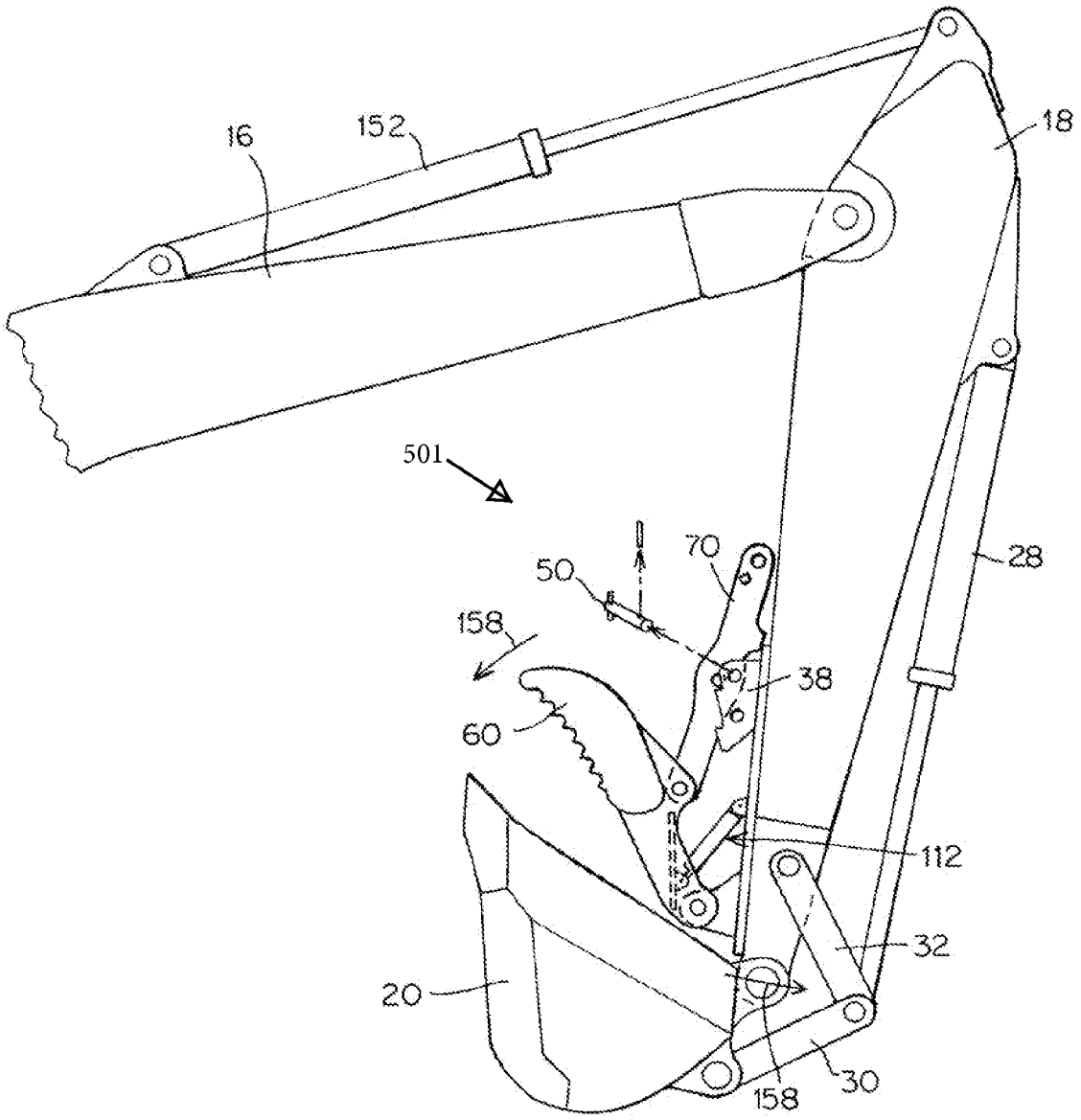
FIG. 6 is a next-in-sequence side view of the positions of the assemblies subsequent to FIG. 5 showing the connecting pin released.

Next, FIG. 6, the rigid link member 70 that fixes the thumb member 60 and the thumb member itself are manually released from their fixed storage positions against the stick 18 by removal of pin 50 and the arm 18 is drivably pivoted to a position sufficient to allow the thumb member 60 to pivot 158 under its own weight toward engagement with the bucket 20 under slowed or dampened movement due to resistance provided by the dampener 112. Next, FIG. 7, the rigid link and thumb member travel or pivot 158 further toward engagement with the bucket 20 under slowed or dampened movement due to resistance provided by the dampener 112. Next, FIG. 8 the thumb member 60 travels further toward and into engagement with the fully pivoted bucket 20 under slowed or dampened movement.

Figure 9:
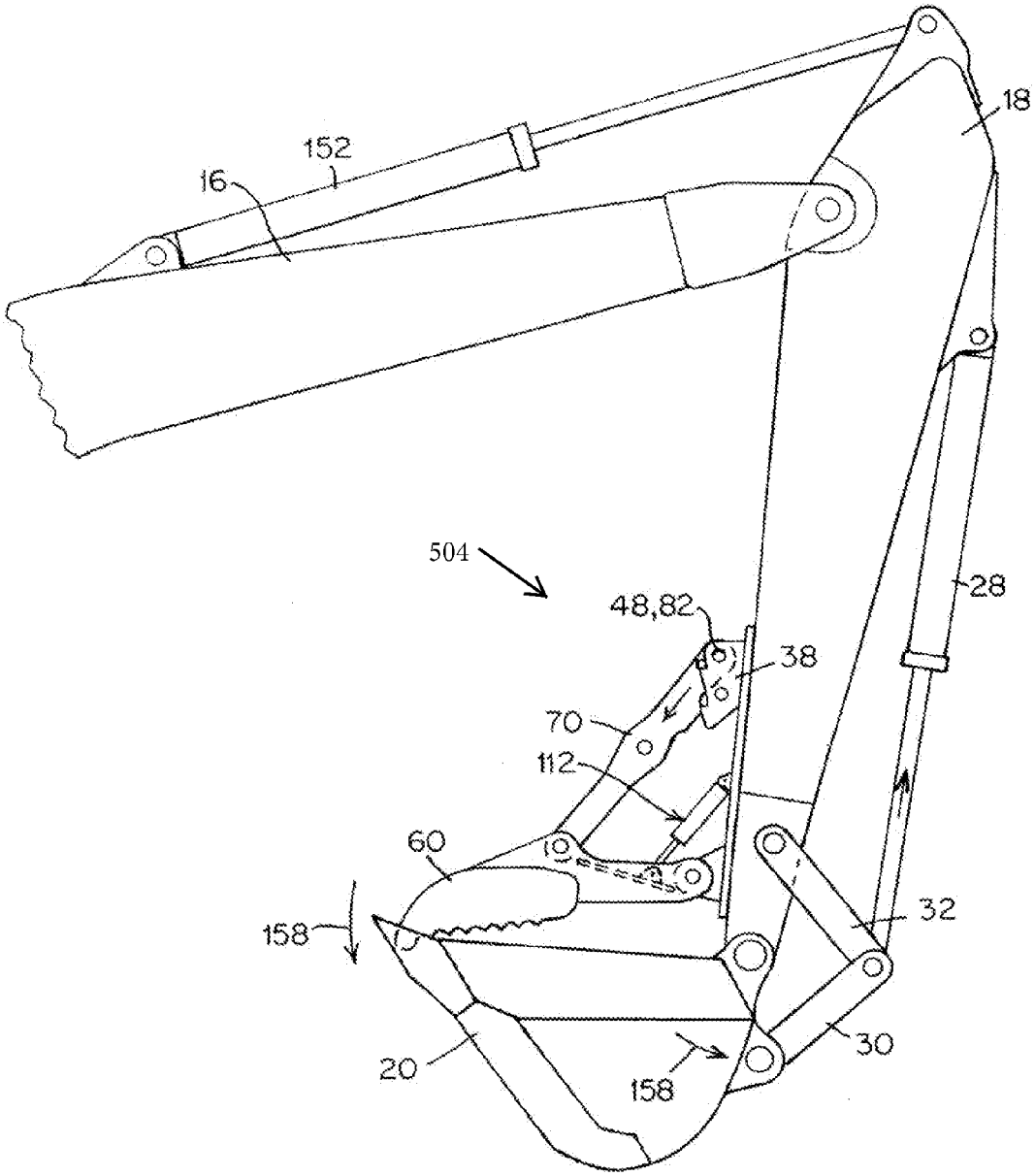
FIG. 9 is a next-in-sequence side view of the positions of the assemblies subsequent to FIG. 8.
Figure 10:
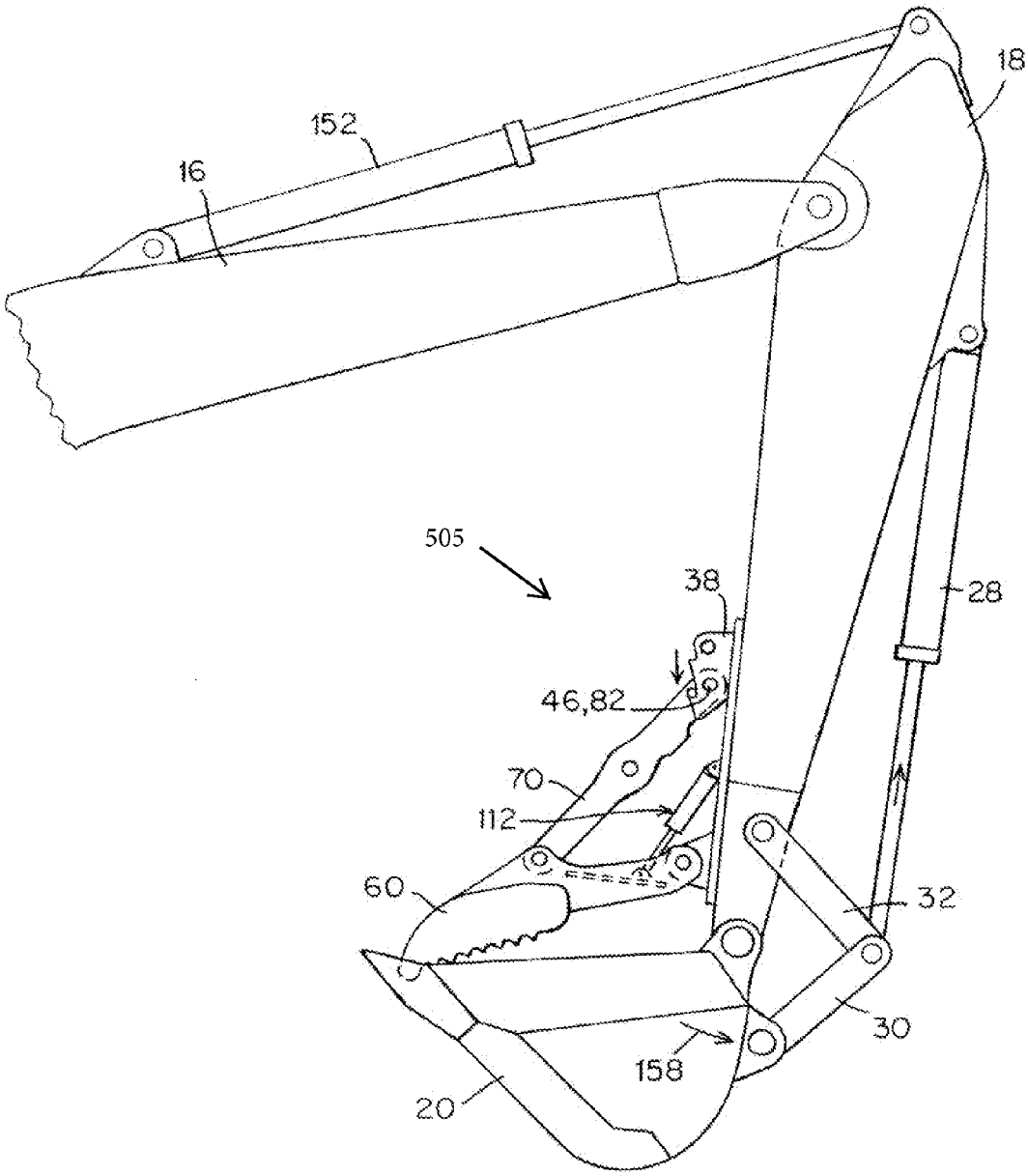
FIG. 10 is a next-in-sequence side view of the positions of the assemblies subsequent to FIG. 9.
Figure 11:
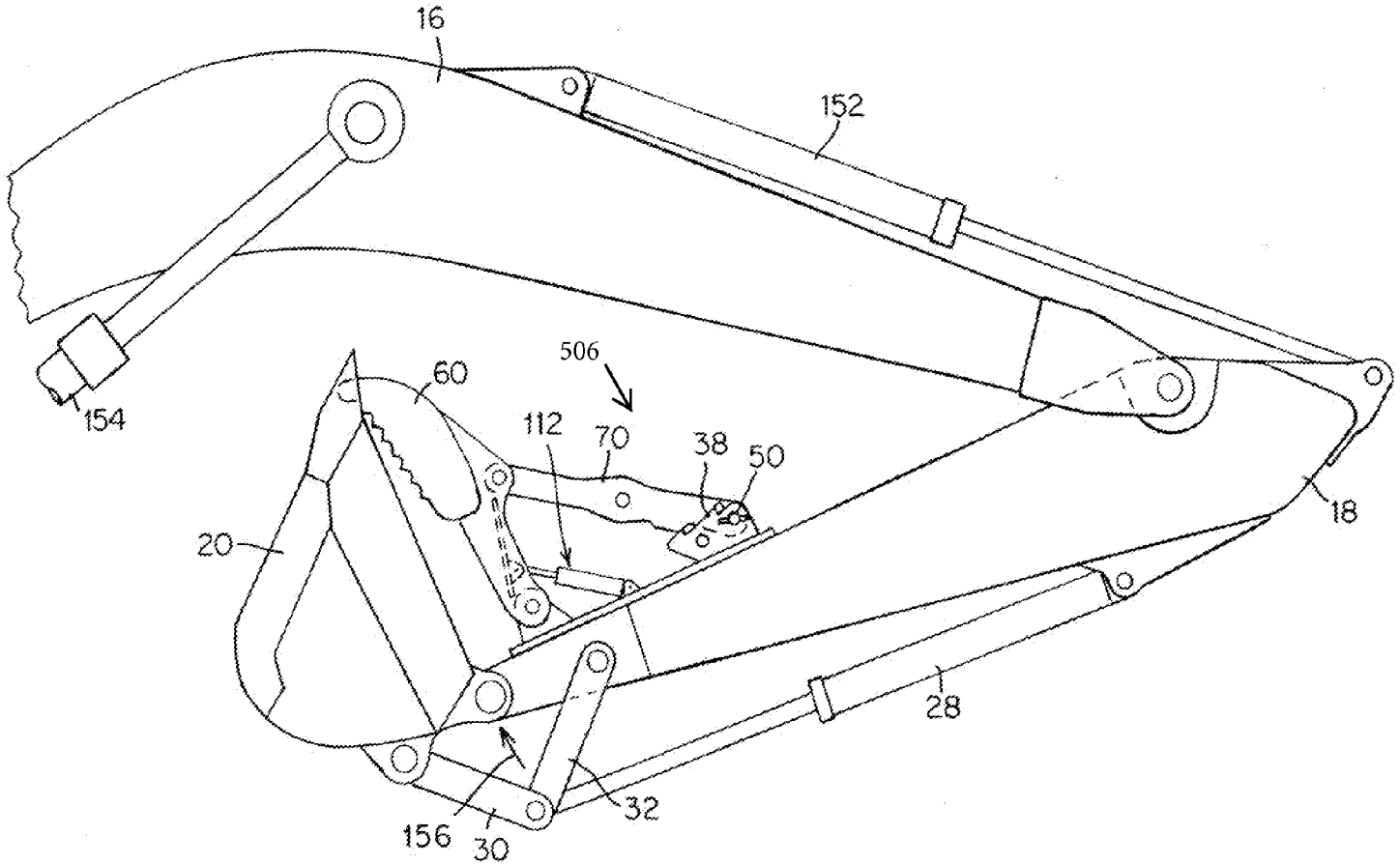
FIG. 11 is a side view of the positions of the thumb and implement system subsequent to FIG. 10.

Next, FIG. 9, the released thumb 60 comes into engagement with the bucket 20 the bucket being pivoted 158 toward a more opened position with the thumb member 60 and its associated rigid link 70 having pivoted closer to a position, FIG. 10, where apertures provided in the rigid link 82 member approach alignment with a pair of complementary apertures 46 for movement of the rigid link 70 and its interconnected thumb member 60 into a fixable operational position, FIG. 11, the thumb member 60 being movable under slowed or dampened movement;

Next, from the FIG. 10 position the released rigid link 70 and thumb member 60 while still in engagement with the bucket 20 in a more opened position, apertures 82 are moved into alignment with complementary apertures 46 such that a user can manually insert pin 50 for fixation into the fixed operational position, FIG. 11;

Subsequent to fixation into the FIG. 11 position, the bucket 20 and boom 16 or arm 18 of the implement system 14 are drivably pivoted 156 to positions where the thumb member 60 is in engagement with the bucket 20 and drivable by the bucket 20 into a pivot position where the thumb member 60 is pivoted into a stable position such that the rigid link 70 can be manually released from its fixed operational position to the base member 34 and readied for further pivoting into the fixed storage position, FIG. 14 during such movement.

Figure 12:
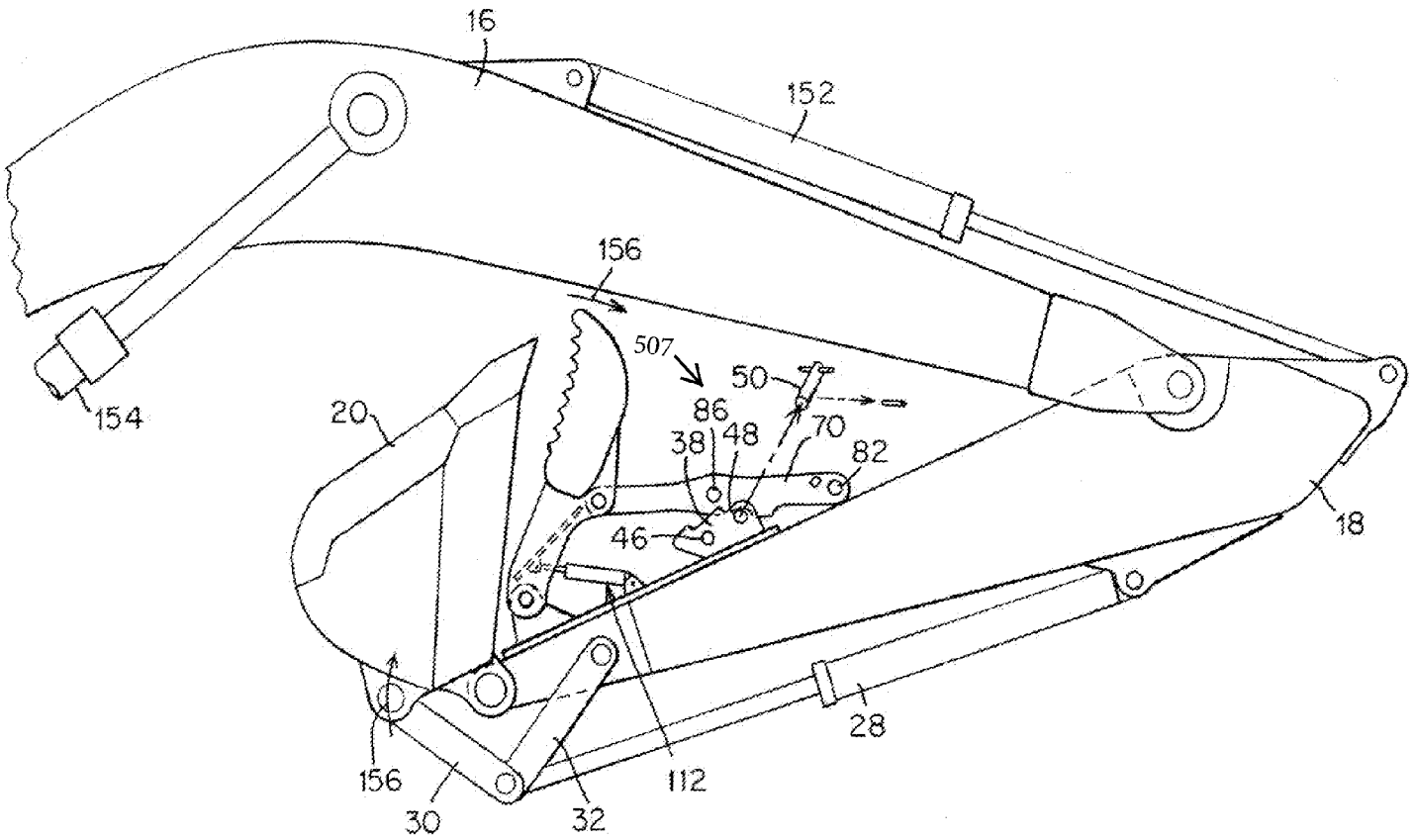
FIG. 12 is a next-in-sequence side view of the positions of the assemblies subsequent to FIG. 11.
Figure 13:
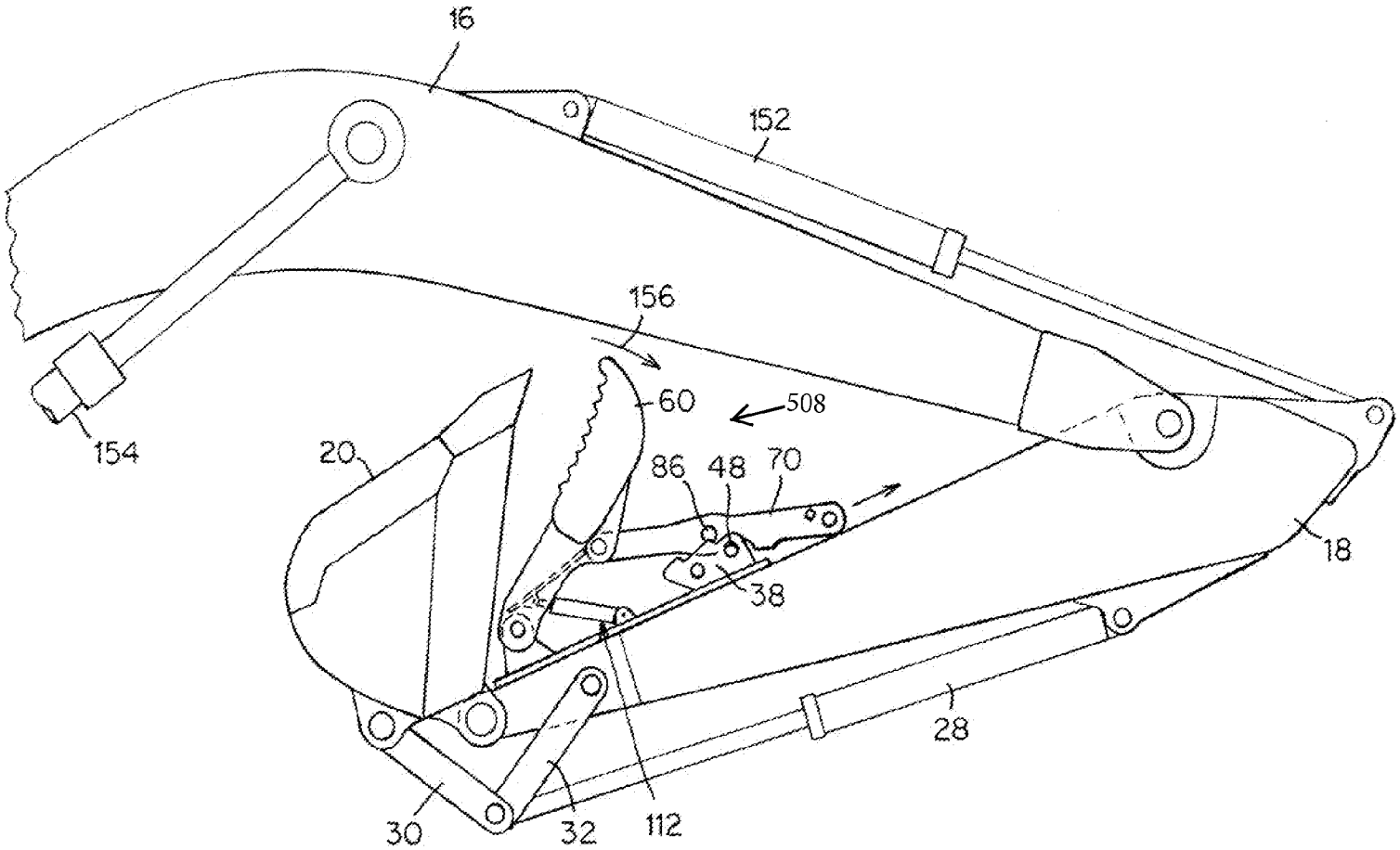
FIG. 13 is a next-in-sequence side view of the positions of the assemblies subsequent to FIG. 12.

As shown in the FIG. 12 next-in-sequence view, the rigid link 70 and thumb member 60 while in engagement with the bucket 20 can be released from the fixed position by removal of pin 50, the bucket being pivoted 156 toward a more closed or stored position. Next, FIG. 13, the released rigid link 70 and thumb member 60 can freely pivot 156 under the weight of the thumb 60 toward a more closed or stored position and closer to a position where apertures 82 provided in the rigid link member 70 are closer to being aligned with a pair of complementary apertures 48 such that a user can manually insert pin 50 for fixation of the rigid link and thumb member into the fixed storage position of FIG. 14, the thumb member 60 pivoting freely a under slowed or dampened movement due to resistance provided by the dampener 112.

It should be apparent to those skilled in the art that various modifications and variations can be made to the thumb assembly and the method of moving a thumb member of a thumb assembly. Other embodiments will be apparent to those skilled in the art from consideration of the specification and practice of the disclosed thumb assembly and the method of moving a thumb member of a thumb assembly. It is intended that the specification and examples be considered as exemplary only, with a true scope being indicated by the following claims and their equivalents.

INDUSTRIAL APPLICABILITY

The disclosed thumb assemblies 10 are particularly suitable for machines, such as excavators, for purposes of incorporating a thumb 60 that freely pivots on an implement system 14 whose free pivoting movement is dampened by a shock absorber or dampener 112 such that the disclosed thumb assembly 10 may be easily placed in various working positions despite being freely pivotable by driving one or both of the arm 18 and a bucket member 20. The dampener 112 is typically a passive device that passively absorbs and dampens the force, energy or free pivoting movement of the thumb member 60. The passivity of the dampener 112 obviates the use of driven mechanisms to dampen pivoting movement and the need for connecting additional components to the thumb member 60 to control its movement. Dampening of the free movement of the thumb member 60 provides control over sudden or otherwise uncontrolled impact of the thumb member with other components of the machine. The dampener can be adapted to cause the rate of pivoting movement to be different between back and forth directions of pivoting.

What is claimed is:

1. A machine comprising:

a frame, an engine, an implement system, a bucket, a thumb member, a passive dampener and an operator station adapted to enable control of movement of the machine;

the thumb member being mounted on the implement system for free dampened pivotable movement on the implement system;

the bucket being controllably pivotably mounted on the implement system and adapted to be movable into controlled engagement under force with the thumb member;

the thumb member being controllably pivotable into selectable pivot positions via controlled pivoting of one or the other or both of the implement system and the bucket member such that a pivot force is exerted on the thumb member;

the passive dampener interconnected between the thumb member and an arm of the implement system in an arrangement wherein the passive dampener comprises an assembly that passively dampens free pivoting movement of the thumb member by absorbing at least a portion of the pivot force exerted on the thumb member, the assembly including a piston slidably mounted within a cylinder, the piston defining a pair of chambers disposed on opposing sides of the piston, the chambers containing a fluid that flows between the chambers on slidable movement of the piston within the cylinder, the fluid absorbing the pivot force of flow between the chambers; and a first and a second valve disposed in the piston, the first valve enabling the fluid to flow at a first flow rate and absorb force at a first absorb rate on slidable movement of the piston in one direction, the second valve enabling the fluid to flow at a second flow rate and absorb force at a second absorb rate on slidable movement of the piston in an opposite direction, the first flow rate differing from the second flow rate.

2. The machine of claim 1 wherein the thumb member is pivotable between at least two positions that are stable under force of gravity on controlled pivoting movement of one or the other or both of the implement system and the bucket between at least two corresponding pivot positions.

3. The machine of claim 1 wherein the thumb member is manually fixable by an operator of the machine into at least two positions that are each fixed against pivoting movement.

4. The machine of claim 1 wherein the pivot force exerted on the thumb member is a force exerted by driving of the bucket into engagement with the thumb member or force of gravity exerted on the thumb member.

5. The machine of claim 1 further comprising a rigid link pivotably connected to the thumb member, the rigid link member being controllably pivotably movable via controlled pivotable movement of one or the other or both of the thumb member and the bucket.

6. The machine of claim 5 wherein the rigid link has first and second apertures that are alignable with corresponding first and second apertures disposed on the arm on pivoting movement of the rigid link, the rigid link being fixedly connectable to the arm by hand on alignment of the first or second apertures of the link member with the corresponding first or second apertures on the arm.

7. The machine claim 1 further comprising a translation assembly drivable to effect translation movement of the machine relative to a ground surface.

8. A method of controllably positioning a thumb member in a machine comprising an implement system controllably pivotably mounted on the machine and a bucket member being controllably pivotably mounted on the implement system, the thumb member being mounted on an arm of the implement system for free back and forth pivotable movement thereon, the method comprising:

controllably pivoting one or the other or both of the arm and the bucket member to cause the thumb member to undergo free pivoting movement under either force of gravity or force of engagement with the bucket member; and passively dampening the free back and forth pivoting movement of the thumb member by interconnecting a dampener between the thumb member and the arm, the dampener including an assembly that operates passively to absorb at least a portion of the force exerted on the thumb member, the assembly including a piston slidably mounted within a cylinder, the piston defining a pair of chambers disposed on opposing sides of the piston, the chambers containing a fluid that flows between the chambers on slidable movement of the piston within the cylinder, the fluid absorbing the pivot force of flow between the chambers, a first and a second valve disposed in the piston, the first valve enabling the fluid to flow at a first flow rate and absorb force at a first absorb rate on slidable movement of the piston in one direction, the second valve enabling the fluid to flow at a second flow rate and absorb force at a second absorb rate on slidable movement of the piston in an opposite direction, the first flow rate differing from the second flow rate.

9. The method of claim 8 wherein the step of passively dampening comprises dampening the back pivoting movement of the thumb member and dampening the forth pivoting movement of the thumb member.

10. The method of claim 8 wherein the step of controllably pivoting comprises:

controllably pivoting the arm to cause the thumb member to pivot under the force of gravity to a first selected pivot position;

controllably pivoting the arm to cause the thumb member to pivot under the force of gravity to a second selected pivot position.

11. The method of claim 8 wherein the first and second selected pivot positions of the thumb member are stable positions wherein the thumb member is engaged under the force of its weight with another member of the machine against pivoting movement.

12. The method of claim 8 wherein the thumb member is selectively fixed by hand against pivoting movement into one or the other of the first and second selected pivot positions.

13. A thumb assembly comprising:

a thumb member mounted on an implement system for back and forth free pivotable movement thereon, a rigid link adjustably interconnectable between the thumb member and an arm of the implement system to fix the thumb member and a passive dampener interconnected between the thumb member and the arm, the passive dampener comprising an assembly that operates passively to dampen the free pivotable back and forth movement of the thumb member, the assembly including a piston slidably mounted within a cylinder, the piston defining a pair of chambers disposed on opposing sides of the piston, the chambers containing a fluid that flows between the chambers on slidable movement of the piston within the cylinder, the fluid absorbing the pivot force of flow between the chambers; and a first and a second valve disposed in the piston, the first valve enabling the fluid to flow at a first flow rate and absorb force at a first absorb rate on slidable movement of the piston in one direction, the second valve enabling the fluid to flow at a second flow rate and absorb force at a second absorb rate on slidable movement of the piston in an opposite direction, the first flow rate differing from the second flow rate.

14. The thumb assembly of claim 13 further comprising a bucket controllably pivotably mounted and arranged on the implement system for controllable engagement with the thumb member, the thumb member being controllably pivotable into selected positions via controlled pivoting of one or the other or both of the arm and the bucket.

* * * * *